United States Patent [19]

Fox

[11] 4,337,451

[45] Jun. 29, 1982

[54] ELECTRICAL SWITCH CONSTRUCTION, SWITCH BLADE SUBASSEMBLY AND METHODS OF MAKING THE SAME

[75] Inventor: Raymond J. Fox, Grove City, Ohio

[73] Assignee: Robertshaw Controls Company, Richmond, Va.

[21] Appl. No.: 210,522

[22] Filed: Nov. 26, 1980

[51] Int. Cl.[3] ..... H01H 61/08

[52] U.S. Cl. ..... 337/93; 29/622; 337/101

[58] Field of Search ..... 337/35, 38-40, 337/44, 51, 57, 84, 87, 92, 93, 94, 96, 99, 368, 369, 303, 101; 29/622

[56] References Cited

U.S. PATENT DOCUMENTS

| | | | |
|---|---|---|---|
| 2,623,137 | 12/1952 | Vogelsberg | 200/122 |
| 2,749,406 | 6/1956 | Clapp | 337/99 |
| 2,813,173 | 11/1957 | Risacher et al. | 337/99 |
| 2,840,664 | 6/1958 | Anderson et al. | 337/101 |
| 3,110,789 | 11/1963 | Hild et al. | 200/122 |
| 3,634,802 | 1/1972 | Aldous | 337/93 |
| 3,636,490 | 1/1972 | Pansing | 337/93 |

*Primary Examiner*—William H. Beha, Jr.
*Attorney, Agent, or Firm*—Candor, Candor & Tassone

[57] ABSTRACT

An electrical switch construction having a housing carrying a thermally cyclable switch blade unit and an adjustable set lever switch blade unit cooperable with the cyclable switch blade unit when the set lever switch blade unit is moved relative to the housing to an operating position thereof by an actuator that is carried by the housing, the housing carrying a calibrating unit for calibrating the set lever switch blade unit. The set lever switch blade unit includes a resilient switch blade having opposed ends and an ambient bimetal lever unit having opposed ends, one of the opposed ends of the switch blade and the ambient bimetal unit being secured together and being the part of the set lever switch blade unit that cooperates with the thermally cyclable switch blade unit. The calibration unit is operatively associated with the other opposed end of the ambient bimetal lever unit to adjust that other opposed end relative to the other opposed end of the switch blade and thereby calibrate the set lever switch blade unit, the other opposed end of the switch blade being secured from movement in the construction.

40 Claims, 9 Drawing Figures

ELECTRICAL SWITCH CONSTRUCTION, SWITCH BLADE SUBASSEMBLY AND METHODS OF MAKING THE SAME

BACKGROUND OF THE INVENTION

1. Field of the Invention

This invention relates to an improved thermally cyclable electrical switch construction and to an improved switch blade subassembly therefor as well as to improved methods of making such an electrical switch construction and such a subassembly.

2. Prior Art Statement

It is known to provide an electrical switch construction having a housing means carrying a thermally cyclable switch blade means and an adjustable set lever switch blade means cooperable with the cyclable switch blade means when the set lever switch blade means is moved relative to the housing means to an operating position thereof by an actuator means that is carried by the housing means, the housing means carrying calibrating means for calibrating the set lever switch blade means.

For example, see the following U.S. Patent:

(1) U.S. Pat. No. 2,623,137—Vogelsberg

It appears that the set lever switch blade means of item (1) above has an ambient bimetal member separate therefrom which will have one end thereof act on the free end of a set lever of the set lever switch blade means with that ambient bimetal lever being pivotally mounted and being calibrated by an adjusting screw acting against the other end of the pivotally mounted ambient bimetal member.

However, it is also known to form the set lever means of the set lever switch blade means from an ambient bimetal member having one end thereof secured to the contact end of the switch blade and the other end thereof secured to a rigid lever member which acts against the actuator cam of the electrical switch construction. The free end of that rigid lever member and the free end of the switch blade are both carried by a spring clip which is adjusted relative to the switch housing to calibrate that set lever switch blade means in the switch housing whereby such calibration movement moves both free ends of the ambient bimetal lever means and the switch blade of the set lever switch blade means in unison.

In other known thermally cyclable electrical switch constructions, the set lever switch blade means is not calibrated and a calibration means is utilized to calibrate the thermally cyclable switch blade means of the electrical switch construction.

For example, see the following U.S. patent:

(2) U.S. Pat. No. 3,110,789—Hild et al.

SUMMARY OF THE INVENTION

It is a feature of this invention to provide an improved thermally cyclable electrical switch construction wherein unique calibration means are provided for calibrating the adjustable set lever switch blade means thereof.

In particular, it was found according to the teachings of this invention that the free end of the ambient bimetal lever means of the adjustable set lever switch blade means can be moved relative to the free end of the switch blade of the set lever switch blade means to calibrate the set lever switch blade means when the free end of the switch blade is secured from movement in the construction whereby the set lever switch blade means pivots at the secured end of the switch blade.

For example, one embodiment of this invention provides an electrical switch construction having a housing means carrying a thermally cyclable switch blade means and an adjustable set lever switch blade means cooperabe with the cyclable switch blade means when the set lever switch blade means is moved relative to the housing means to an operating position thereof by an actuator means that is carried by the housing means. The housing means carries calibrating means for calibrating the set lever switch blade means, the set lever switch blade means comprising a resilient switch blade having opposed ends. One of the opposed ends of the switch blade and the ambient bimetal lever means are secured together and form the part of the set lever switch blade means that cooperates with the thermally cyclable switch blade means. The calibration means is operatively associated with the other opposed end of the ambient bimetal lever means to adjust that other opposed end relative to the other opposed end of the switch blade and thereby calibrate the set lever switch blade means, the other opposed end of the switch blade being secured to the construction.

It is another feature of this invention to provide an improved subassembly of the adjustable set lever switch blade means for a thermally cyclable electrical switch construction or the like.

In particular, it was found according to the teachings of this invention that a self-contained subassembly of an adjustable set lever switch blade means can be provided wherein the calibration means for the adjustable set lever switch blade means forms a part of the subassembly and can adjust the free end of the ambient bimetal lever means relative to the free end of the switch blade, the free end of the switch blade being secured from movement in the subassembly.

For example, one embodiment of this invention provides a self-contained subassembly of an adjustable set lever switch blade means for an electrical switch construction having a housing means carrying a thermally cyclable switch blade means that cooperates with the adjustable set lever switch blade means when the set lever switch blade means is moved relative to the housing means to an operating position thereof by an actuator means that is carried by the housing means. The set lever switch blade means comprises a resilient switch blade having opposed ends and an ambient bimetal lever means having opposed ends, one of the opposed ends of the switch blade and the ambient bimetal lever means being secured together and being the part of the set lever switch blade means that cooperates with the thermally cyclable switch blade means. A calibration means comprises part of the subassembly and is operatively associated with the other opposed end of the ambient bimetal lever means to adjust that other opposed end relative to the other opposed end of the switch blade and thereby calibrate the set lever switch blade means, the other opposed end of the switch blade being secured from movment in the subassembly.

Accordingly, it is an object of this invention to provide an improved thermally cyclable electrical switch construction having one or more of the novel features of this invention as set forth above or hereinafter shown or described.

Another object of this invention is to provide a method of making such an electrical switch construction, the method of this invention having one or more of the novel features of this invention as set forth above or hereinafter shown or described.

Another object of this invention is to provide an improved self-contained subassembly of an adjustable set lever switch blade means, the subassembly of this invention having one or more of the novel features of this invention as set forth above or hereinafter shown or described.

Another object of this invention is to provide a method of making such a self-contained subassembly, the method of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

DESCRIPTION OF THE PREFERRED EMBODIMENTS

Figure 1:
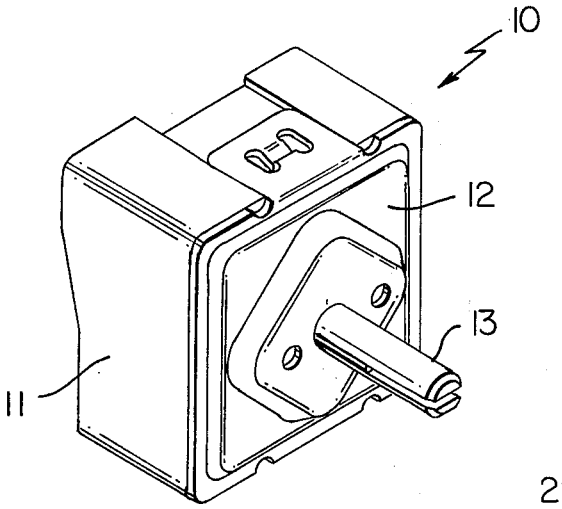
FIG. 1 is a front perspective view of the improved electrical switch construction of this invention.

While the various features of this invention are hereinafter described and illustrated as being particularly adapted to provide a thermally cyclable electrical switch construction, it is to be understood that the various features of this invention can be utilized singly or in any combination thereof to provide other types of electrical switch constructions as desired.

Therefore, this invention is not to be limited to only the embodiments illustrated in the drawings, because the drawings are merely utilized to illustrate one of the wide variety of uses of this invention.

Referring now to the drawings, the improved thermally cyclable electrical switch construction of this invention is generally indicated by the reference numeral 10 and comprises a housing means 11 that is closed by a cover member 12 and through which an actuating shaft 13 extends to have a suitably formed control knob (not shown) mounted thereon for rotating the selector shaft 13 to various desired operating positions thereof as will be apparent hereinafter.

The selector shaft 13 carries an actuator cam member 14 which has one cam surface 15 for opening and closing a main electrical switch means that is generally indicated by the reference numeral 16 and does not form part of the claimed invention. Therefore, it is only necessary to state that when the selector shaft 13 is moved to any "on" position thereof, the cam surfce 15 closes a movable contact 17 of the main electrical switch means 16 against a fixed contact 18 thereof so as to permit electrical current to be directed through the load to a thermally cyclable electrical switch means that is generally indicated by the reference numeral 19 in FIG. 5 and forms the claimed features of this invention.

The actuator cam 14 has a cam surface 20 which is utilized to adjust the operating position of an adjustable set lever switch blade means 21 of the electrical switch means 19 relaive to a thermally cyclable switch blade means that is generally indicated by the reference numeral 22.

Figure 3:
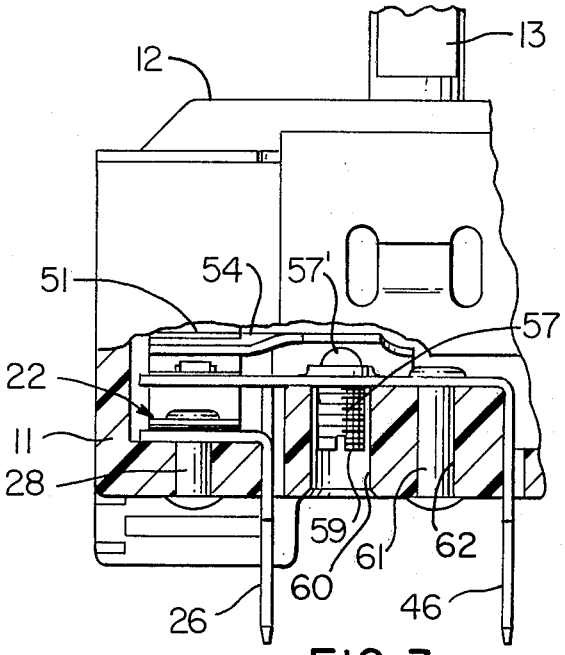
FIG. 3 is an enlarged fragmentary side view of the electrical switch construction of FIG. 1 with part of the housing broken away and shown in cross section.
Figure 2:
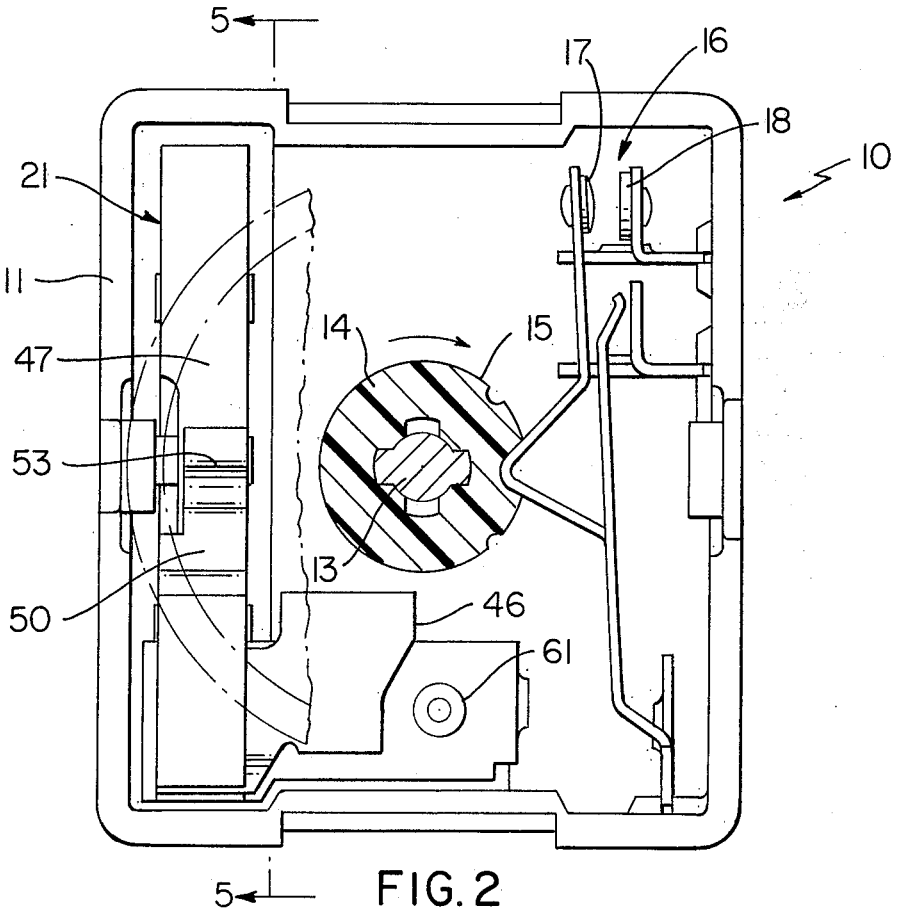
FIG. 2 is an enlarged front view of the electrical switch construction of FIG. 1 with the cover removed and the part of the actuating cam shown in phantom lines and in cross section.
Figure 4:
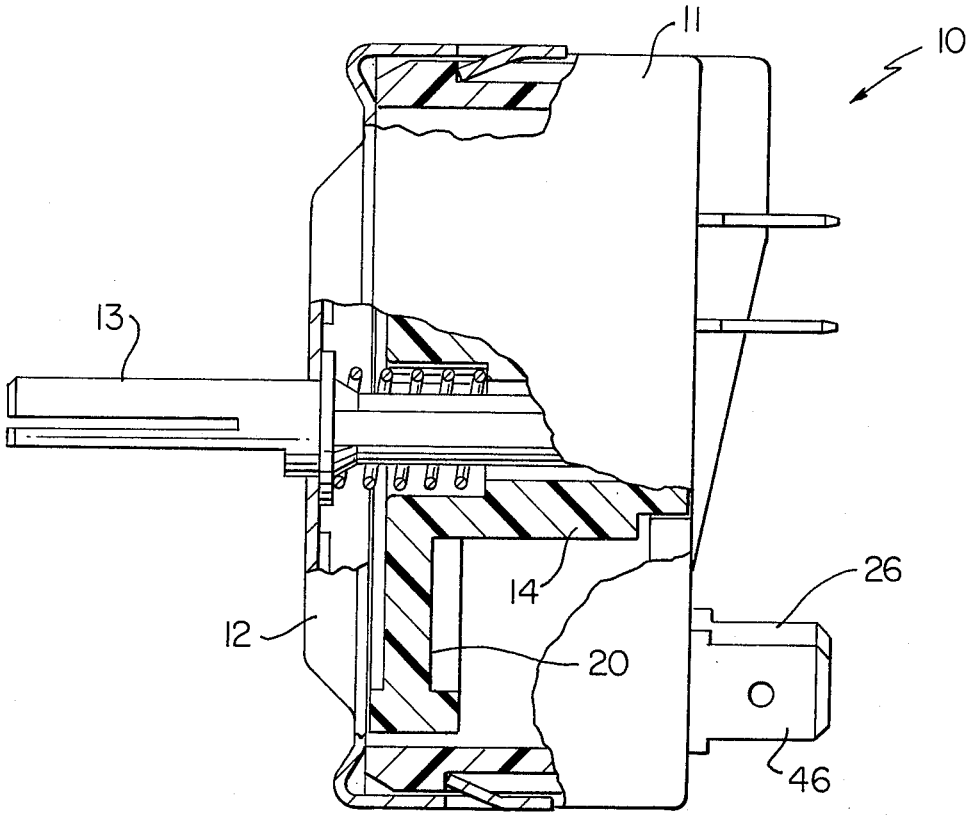
FIG. 4 is another enlarged side view of the electrical switch construction of FIG. 1 with certain parts thereof broken away and shown in cross section.

The thermally cyclable switch blade means 22 comprises a bimetal switch blade 23 carrying an electrical contact 24 on one end 25 thereof and being adapted to be secured to an L-shaped terminal 26 at the other end 27 thereof by a rivet 28, FIG. 3, passing through an opening 29 in the bimetal switch blade 23 and an aligned opening 30 in the terminal 26.

An electrically conductive heater member 31 is disposed in sandwiched relation with the bimetal switch blade 23 with two electrically insulating strips 32 and 33 disposed therebetween and a third insulator strip 34 disposed on the other side of the heater member 31, the members 23, 32, 33, 31 and 34 being held in the stacked sandwiched relation by the plurality of spaced apart staple-like clips 35. A similar arrangement is disclosed in the U.S. patent to Rosenberg et al., U.S. Pat. No. 3,905,003 and the disclosure of such patent is incorporated into this disclosure by reference.

The end 36 of the heater strip 31 is directly spot welded to the L-shaped terminal 26 so as to be electrical interconnected thereto while the other end 37 of the heater strip 31 is spot welded to one end 38 of a substantially U-shaped spring member 39 that has its other end 40 spot welded to the end 25 of the bimetal switch blade 23.

In this manner, when electrical current is permitted to flow through the heater member 31 from the end 36 thereof to the end 37 thereof, the heater member 31 heats up and, thus, heats the bimetal member 23 to cause the bimetal member 23 to bend in a manner to move the contact 24 thereof away from the set lever switch blade means 21. Conversely, when the bimetal member 23 cools, the bimetal switch blade 23 tends to bend toward the set lever switch blade means 21 whereby the switch blade means 19 will be thermally cycled between opened and closed conditions thereof as will be apparent hereinafter.

It has been found that during the heating of the heater strip 31, the same tends to elongate relative to the bimetal member 23 and thereby has the end 37 act on the spring member 39 in a manner to tend to increase the deflection of the bimetal member 23 in a direction to more fully close the contact 24 against the set lever switch blade means 21 whereas as the heater strip 31 cools, the same tends to contract in length relative to the bimetal member 22 and through the spring 39 tends to cause the bimetal member 23 to more fully deflect away from the set lever switch blade means 21. This action is believed to assist the making and breaking of the thermally cyclable switch means 19 as will be apparent hereinafter and is believed to occur if the clips 35 do not fasten the parts 23, 32, 33, 31 and 34 too tightly in the sandwich thereof.

The insulator strips 32 and 33 are fastened by the rivet 28 to the terminal 26 as the same having fastening openings 32' and 33' passing therethrough in aligned relation with the previously described fastening openings 29 and 30. Also, the bimetal member 23 has a bend 23' therein to prevent any burs on the heater end 36 from penetrating the insulator strips 33 and 32 to short against the bimetal member 23.

Figure 5:
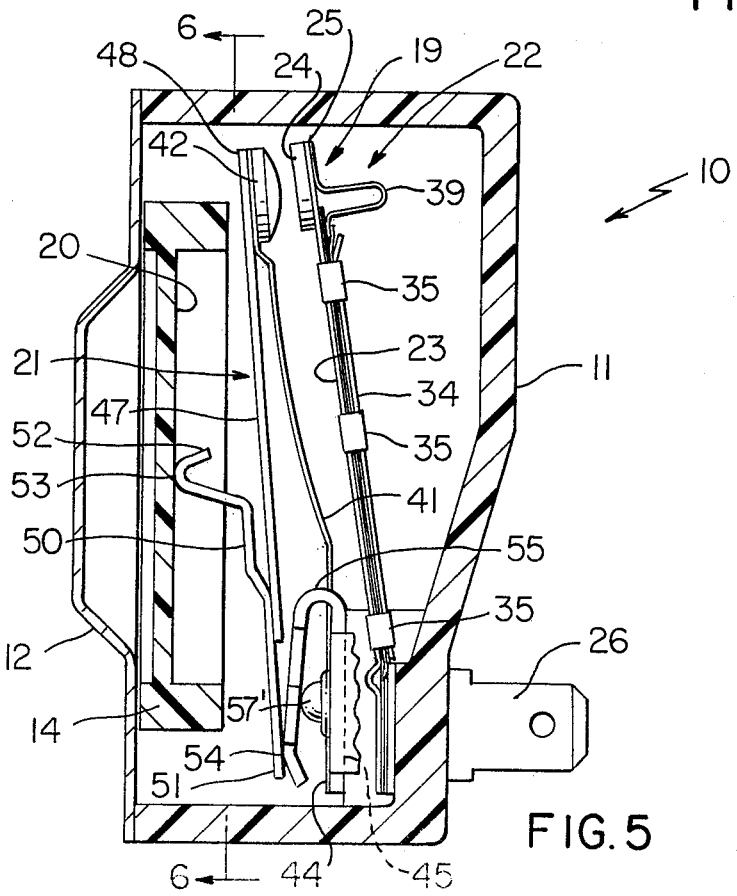
FIG. 5 is a cross-sectional view taken on lines 5—5 of FIG. 2.
Figure 6:
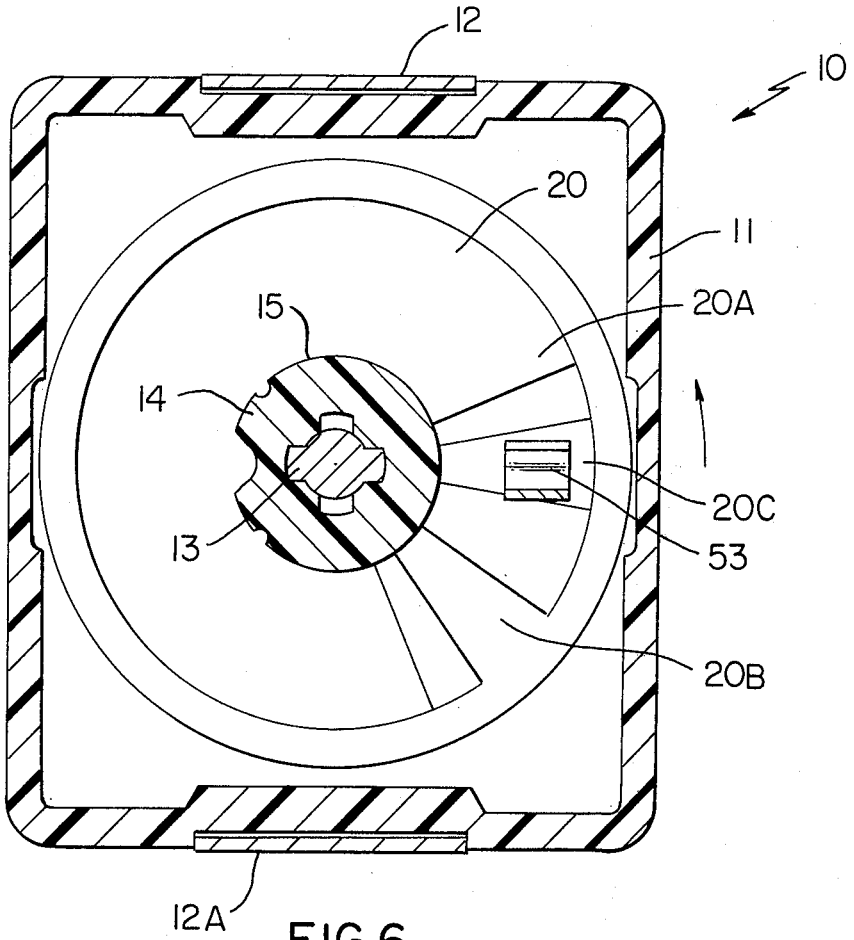
FIG. 6 is a cross-sectional view taken on lines 6—6 of FIG. 5.
Figure 9:
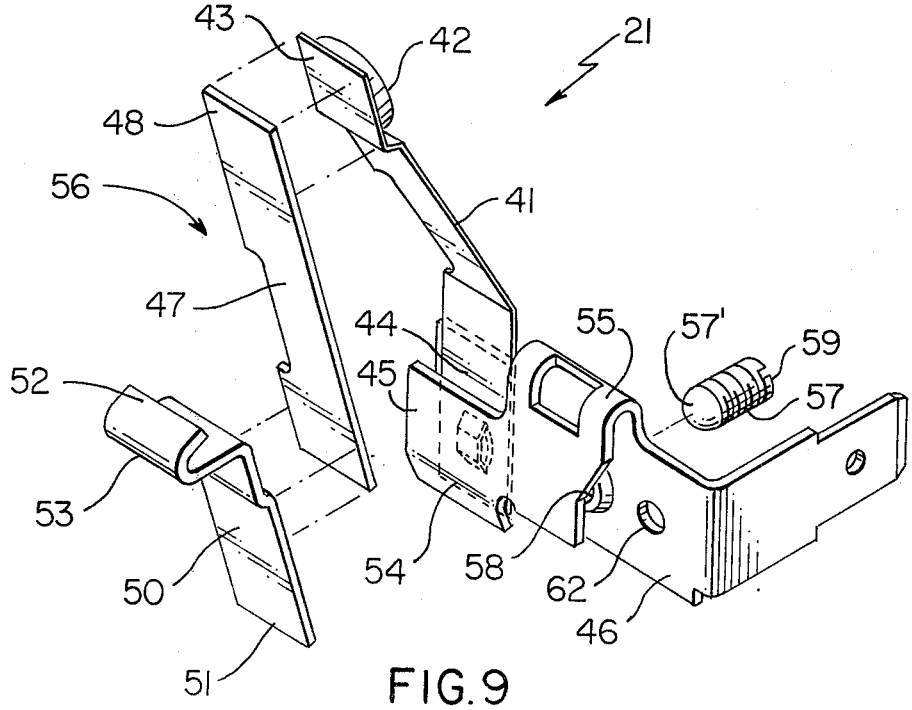
FIG. 9 is an exploded perspective view illustrating the parts of the adjustable set lever switch blade means of the electrical switch construction of FIG. 1.

The adjustable set lever switch blade means 21 as illustrated in FIGS. 5 and 9, includes a spring switch blade 41 carrying an electrical contact 42 on the end 43 thereof that cooperates with the electrical contact 24 of the thermally cyclable switch blade means 22.

The other end 44 of the switch blade member 41 is secured to a section 45 of a terminal member 46 in any suitable manner. In particular, the end 44 of the switch blade 41 is presently preferred to be secured to the section 45 of the terminal 46 by the lacing and staking operation that is fully set forth in the U.S. patent to Marquis U.S. Pat. No. 4,059,897, whereby the details of such lacing and staking operation need not be further described as such patent is also being incorporated into this disclosure by reference thereto.

An ambient bimetal member 47 has one end 48 thereof secured by spot welding or the like to the end 43 of the switch blade 41 while the other end 49 thereof is secured by spot welding or the like to a rigid lever member 50 intermediate the ends 51 and 52 of the lever member 50, the ambient bimetal member 47 and the lever member 50 comprising an ambient bimetal lever means 56 of the set lever switch blade means 21 and compensates for any changes in ambient temperature that might effect the setting of the device 10 in a manner well known in the art.

The end 52 of the lever member 50 is bent into the U-shape illustrated so as to have the arcuate surface 53 thereof adapted to bear against the cam surface 20 of the actuator cam 14 whereby the set lever switch blade means 21 is adapted to be set by the cam surface 20 of the actuator cam 14 in a manner hereinafter described, the normal bias of the spring switch blade 41 being toward the cam surface 20.

The other end 51 of the lever member 50 is adapted to engage against a section 54 of the terminal 46 which is folded over the section 45 thereof by an integral hinging means 55 of the terminal 46. In this manner, the position of the end 51 of the ambient bimetal lever means 56 relative to the fixed end 44 of the switch blade 41 can be adjusted as the end 51 always bears against the section 54 of the terminal 46.

In order to calibrate the position of the terminal section 54 relative to the terminal section 45 of the terminal 46, an adjusting screw 57 is threaded in a threaded opening 58 of the section 45 of the terminal 46 so that the end 57' of the adjusting screw 57 can bear against the section 54 and through the resiliency of the hinge means 55 can position the section 54 relative to the section 45. In this manner, the end 51 of the ambient bimetal lever means 56 is adjusted relative to the end 44 of the switch blade 41 and, thus, the position of the contact 42 in the housing means 11 is calibrated relative thereto by the set screw 57 as the switch blade 41 is pivoted about the fixed end 44 thereof.

The set screw 57 has a bifurcated end 59 thereof exposed to the exterior of the housing means 11 as the housing means 11 has an opening 60, FIG. 3, passing therethrough to permit a user to insert a screw driver head therein and turn the adjusting screw 57 when it is desired to calibrate the adjustable set lever switch blade means 21 as will be apparent hereinafter.

Therefore, it can be seen that the thermally cyclable electrical switch means 19 of this invention can be formed in a relatively simple and effective manner as a self-contained subassembly to operate in a manner now to be described.

As illustrated in FIG. 5, the actuator cam 14 is disposed in an "off" position thereof whereby the normal resiliency of the spring blade 41 of the set lever switch blade means 21 tends to move the set lever switch blade means 21 to the left in FIG. 5 away from the thermally cyclable switch blade means 22 which has a normal position as illustrated in FIG. 5 when the same is in an unheated condition thereof.

However, when the operator turns the actuator shaft 13 to any "on" position thereof, the cam surface 20 of the actuator cam 14 cams against the end 52 of the lever member 51 of the ambient bimetal lever means 56 to move the ambient bimetal lever means 56 to the right in FIG. 5 and place the contact 42 thereof into electrical contact with the contact 24 of the thermally cyclable switch blade means 22.

As previously stated, when the actuator cam 14 is moved to an "on" position thereof, the main switch means 16 is closed to permit electrical current to pass through the thermally cyclable switch means 19 between the terminals 26 and 46 thereof when the contacts 42 and 24 are in contact with each other.

Accordingly, with the contacts 42 and 24 now in contact with each other, electrical current now passes through the heater member 31 to cause the same to begin to heat up and as the heater member heats up to a certain degree thereof, the heat from the heater member 31 heats the bimetal member 23 of the thermally cyclable switch blade means 22 in such a manner that the same bends to the right in FIG. 5 to move the fixed contact 24 out of contact with the contact 42 of the set lever switch blade means 21.

As previously stated, when the electrical current through the heater 31 now ceases to exist because the contact 24 is out of contact with the contact 42, the heater strip 31 tends to contract in length relative to the bimetal member 23 and thereby pulls on the spring 39 to cause the spring 39 to further bow the bimetal member 23 in a direction away from the contact 42 of the set lever switch blade means 21. Conversely, when the contacts 24 and 42 are in contact with each other, the heater 31 is heating up and causes itself to elongate relative to the bimetal member 23 in a manner to act on the spring 39 in a direction to cause the spring 39 to further deflect the bimetal 23 toward the contact 42 so as to maintain the contacs 24 and 42 in good electrical contact with each other until the bimetal member 23 is heated up to cause the same to move away from the set lever switch blade means 21.

Accordingly, when the bimetal member 23 subsequently cools, because the heater strip 31 is no longer having electrical current pass therethrough, the bimetal member 23 warps back towards the set lever switch blade means 21 to place its contact 24 into contact with the contact 42 and thereby permit the heater strip 31 to again heat up to provide its cycle operation.

Figure 7:
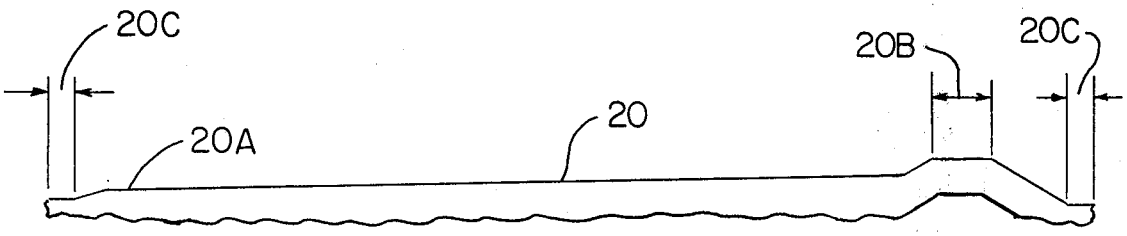
FIG. 7 is a schematic view illustrating the cam surface of the actuating cam illustrated in FIG. 6.
Figure 8:
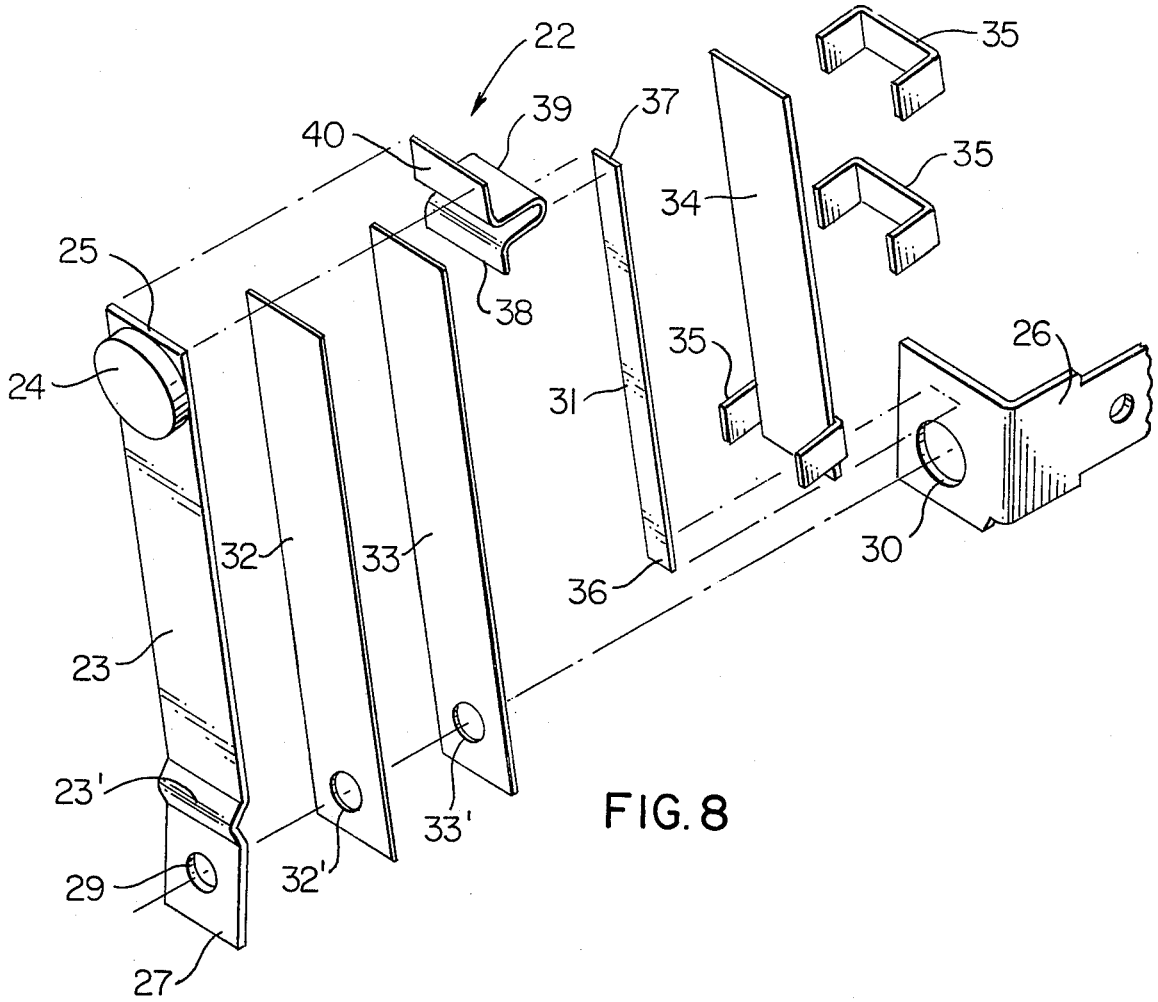
FIG. 8 is an exploded perspective view of the various parts that form the thermally cyclable switch blade means of the electrical switch construction of FIG. 1.

In this manner, it can be seen that electrical current between the terminals 26 and 46 will be cycled on and off and the particular rate of "on" and "off" action is determined by the initial set position of the set lever switch blade means 21 as determined by the particular portion of the cam surface 20 acting on the end 52 of the set lever switch blade means 21, such cam surface being schematically illustrated in FIG. 7 to show the gradual rise thereof from a low position 20A to a high position 20B thereof in relation to the "off" position 20C thereof.

As previously stated the initial position of the set lever switch blade means 21 in the housing means 11 of electrical switch construction 10 can be calibrated by turning the set screw 57 to thereby set the position of the section 54 of the terminal 46 relative to the section 45 thereof and, thus, set the free end 51 of the ambient bimetal lever means 56 of the set lever switch blade means 21 relative to the fixed end 44 of the switch blade 41. Such calibrating actions sets the position of the contact 42 relative to the contact 24 of the thermally cyclable switch blade means 22 as the switch blade 41 pivots at its fixed end 44.

Therefore, it can be seen that the set lever switch blade means 21 comprises a self-contained subassembly 21 that is adapted to be secured in the housing means 11 by merely having the terminal 46 fastened thereto in any suitable manner, such as by having a rivet 61, FIG. 3, fasten the terminal 46 thereto at a rivet opening 62 thereof, the self-contained subassembly 21 carrying its own calibrating means 57, 54 for the ambient bimetal lever means 56 thereof.

Accordingly, not only does this invention provide an improved thermally cyclable electrical switch construction and parts therefor, but also this invention provides an improved method of making such an electrical switch construction and parts therefor.

While the forms and methods of this invention now preferred have been illustrated and described as required by the Patent Statute, it is to be understood that other forms and method steps can be utilized and still fall within the scope of the appended claims.

What is claimed is:

1. In an electrical switch construction having a housing means carrying a thermally cyclable switch blade means and an adjustable set lever switch blade means cooperable with said cyclable switch blade means when said set lever switch blade means is moved relative to said housing means to an operating position thereof by an actuator means that is carried by said housing means, said housing means carrying calibrating means for calibrating said set lever switch blade means, said set lever switch blade means comprising a resilient switch blade having opposed ends and an ambient bimetal lever means having opposed ends, one of said opposed ends of said switch blade and said ambient bimetal lever means being secured together and being the part of said set lever switch blade means that cooperates with said thermally cyclable switch blade means, the improvement wherein said calibration means is operatively associated with the other opposed end of said ambient bimetal lever means to adjust that other opposed end relative to the other opposed end of said switch blade and thereby calibrate said set point switch blade means, said other opposed end of said switch blade being secured to said construction.

2. An electrical switch construction as set forth in claim 1 wherein said calibration means has adjusting means thereof accessible from the exterior of said housing means whereby said set lever switch blade means can be readily calibrated.

3. An electrical switch construction as set forth in claim 2 wherein said adjusting means is rotatable.

4. An electrical switch construction as set forth in claim 3 wherein said adjusting means comprises an adjusting screw threadedly carried by said construction.

5. An electrical switch construction as set forth in claim 4 wherein said housing means has an aperture means leading from the exterior thereof to said adjusting screw.

6. An electrical switch construction as set forth in claim 1 wherein said calibration means includes a resilient hinge means having two sections hinged together, one of said sections being secured to said housing means, said other opposed end of said ambient bimetal lever means engaging against the other of said sections, said calibration means including an adjusting means acting on said other of said sections to move the same relative to said one of said sections and thereby adjust the position of said other opposed end of said ambient bimetal lever means relative to said other opposed end of said switch blade.

7. An electrical switch construction as set forth in claim 6 wherein said sections of said resilient hinge means are integrally hinged together whereby said resilient hinge means is a one-piece member.

8. An electrical switch construction as set forth in claim 7 wherein said adjusting means is carried by said one of said sections.

9. An electrical switch construction as set forth in claim 8 wherein said adjusting means comprises a threaded member threaded to said one of said sections and having an end bearing against said other of said sections.

10. An electrical switch construction as set forth in claim 9 wherein said other opposed end of said switch blade is secured to said one of said sections of said resilient hinge means.

11. In a method of making an electrical switch construction having a housing means carrying a thermally cyclable switch blade means and an adjustable set lever switch blade means cooperable with said cyclable switch blade means when said set lever switch blade means is moved relative to said housing means to an operating position thereof by an actuator means that is carried by said housing means, said housing means carrying calibrating means for calibrating said set lever switch blade means, said set lever switch blade means comprising a resilient switch blade having opposed ends and an ambient bimetal lever means being secured together and being the part of said set lever switch blade means that cooperates with said thermally cyclable switch blade means, the improvement comprising the steps of disposing said calibration means to be operatively associated with the other opposed end of said ambient bimetal lever means to adjust that other opposed end relative to the other opposed end of said switch blade and thereby calibrate said set point switch blade means, and securing said other opposed end of said switch blade to said construction.

12. A method of making an electrical switch construction as set forth in claim 11 and including the step of forming said calibration means with adjusting means thereof accessible from the exterior of said housing means whereby said set lever switch blade means can be readily calibrated.

13. A method of making an electrical switch construction as set forth in claim 12 and including the step of forming said adjusting means to be rotatable.

14. A method of making an electrical switch construction as set forth in claim 13 and including the step of forming said adjusting means to comprise an adjusting screw threadedly carried by said construction.

15. A method of making an electrical switch construction as set forth in claim 14 and including the step of forming said housing means with an aperture means that leads from the exterior thereof to said adjusting screw.

16. A method of making an electrical switch construction as set forth in claim 11 and including the steps of forming said calibration means to include a resilient hinge means having two sections hinged together, securing one of said sections to said housing means, engaging said other opposed end of said ambient bimetal lever means against the other of said sections, and forming said calibration means to include an adjusting means acting on said other of said sections to move the same relative to said one of said sections and thereby adjust the position of said other opposed end of said ambient bimetal lever means relative to said other opposed end of said switch blade.

17. A method of making an electrical switch construction as set forth in claim 16 and including the step of forming said sections of said resilient hinge means to be integrally hinged together whereby said resilient hinge means is a one-piece member.

18. A method of making an electrical switch construction as set forth in claim 17 and including the step of forming said adjusting means to be carried by said one of said sections.

19. A method of making an electrical switch construction as set forth in claim 18 and including the step of forming adjusting means to comprise a threaded member threaded to said one of said sections and have an end bearing against said other of said sections.

20. A method of making an electrical switch construction as set forth in claim 19 and including the step of securing said other opposed end of said switch blade to said one of said sections of said resilient hinge means.

21. In a self-contained subassembly of an adjustable set lever switch blade means for an electrical switch construction having a housing means carrying a thermally cyclable switch blade means that cooperates with said adjustable set lever switch blade means when said set lever switch blade means is moved relative to said housing means to an operating position thereof by an actuator means that is carried by said housing means, said housing means carrying calibrating means for calibrating said set lever switch blade means, said set lever switch blade means comprising a resilient switch blade having opposed ends and an ambient bimetal lever means having opposed ends, one of said opposed ends of said switch blade and said ambient bimetal lever means being secured together and being the part of said set lever switch blade means that cooperates with said thermally cyclable switch blade means, the improvement wherein said calibration means comprises part of said subassembly and is operatively associated with the other opposed end of said ambient bimetal lever means to adjust that other opposed end relative to the other opposed end of said switch blade and thereby calibrate said set point switch blade means, said other opposed end of said switch blade being secured from movement in said subassembly.

22. A subassembly as set forth in claim 21 wherein said calibration means has adjusting means thereof adapted to be accessible from the exterior of said housing means whereby said set lever switch blade means can be readily calibrated.

23. A subassembly as set forth in claim 22 wherein said adjusting means is rotatable.

24. A subassembly as set forth in claim 23 wherein said adjusting means comprises an adjusting screw threadedly carried by said subassembly.

25. A subassembly as set forth in claim 24 wherein said ambient bimetal lever means comprises a bimetal member and a rigid arm secured together in overlapping relation.

26. A subassembly as set forth in claim 21 wherein said calibration means includes a resilient hinge means having two sections hinged together, one of said sections being adapted to be secured to said housing means, said other opposed end of said ambient bimetal lever means engaging against the other of said sections, said calibration means including an adjusting means acting on said other of said sections to move the same relative to said one of said sections and thereby adjust the position of said other opposed end of said ambient bimetal lever means relative to said other opposed end of said switch blade.

27. A subassembly as set forth in claim 26 wherein said sections of said resilient hinge means are integrally hinged together whereby said resilient hinge means is a one-piece member.

28. A subassembly as set forth in claim 27 wherein said adjusting means is carried by said one of said sections.

29. A subassembly as set forth in claim 28 wherein said adjusting means comprises a threaded member threaded to said one of said sections and having an end bearing against said other of said sections.

30. A subassembly as set forth in claim 29 wherein said other opposed end of said switch blade is secured to said one of said sections of said resilient hinge means.

31. In a method of making a self-contained subassembly of an adjustable set lever switch blade means for an electrical switch construction having a housing means carrying a thermally cyclable switch blade means that cooperates with said adjustable set lever switch blade means when said set lever switch blade means is moved relative to said housing means to an operating position thereof by an actuator means that is carried by said housing means, said housing means carrying calibrating means for calibrating said set lever switch blade means, said set lever switch blade means comprising a resilient switch blade having opposed ends and an ambient bimetal lever means having opposed ends, one of said opposed ends of said switch blade and said ambient bimetal lever means being secured together and being the part of said set lever switch blade means that cooperates with said thermally cyclable switch blade means, the improvement comprising the steps of forming said calibration means to comprise part of said subassembly and be operatively associated with the other opposed end of said ambient bimetal lever means to adjust that other opposed end relative to the other opposed end of said switch blade and thereby calibrate said set point switch blade means, and securing said other opposed end of said switch blade from movement in said subassembly.

32. A method of making a subassembly as set forth in claim 31 and including the step of forming said calibration means with adjusting means thereof adapted to be accessible from the exterior of said housing means whereby said set lever switch blade means can be readily calibrated.

33. A method of making a subassembly as set forth in claim 32 and including the step of forming said adjusting means to be rotatable.

34. A method of making a subassembly as set forth in claim 33 and including the step of forming said adjusting means to comprise an adjusting screw threadedly carried by said subassembly.

35. A method of making a subassembly as set forth in claim 34 and including the step of forming said ambient bimetal lever means from a bimetal member and a rigid arm secured together in overlapping relation.

36. A method of making a subassembly as set forth in claim 31 and including the steps of forming said calibration means to include a resilient hinge means having two sections hinged together, forming one of said sections to be adapted to be secured to said housing means, engaging said other opposed end of said ambient bimetal lever means against the other of said sections, and forming said calibration means to include an adjusting means acting on said other of said sections to move the same relative to said one of said sections and thereby adjust the position of said other opposed end of said ambient bimetal lever means relative to said other opposed end of said switch blade.

37. A method of making a subassembly as set forth in claim 36 and including the step of forming said sections of said resilient hinge means to be integrally hinged together whereby said resilient hinge means is a one-piece member.

38. A method of making a subassembly as set forth in claim 37 and including the step of forming said adjusting means to be carried by said one of said sections.

39. A method of making a subassembly as set forth in claim 38 and including the step of forming said adjusting means to comprise a threaded member threaded to said one of said sections and have an end bearing against said other of said sections.

40. A method of making a subassembly as set forth in claim 39 and including the step of securing said other opposed end of said switch blade to said one of said sections of said resilient hinge means.

* * * * *

UNITED STATES PATENT AND TRADEMARK OFFICE

CERTIFICATE OF CORRECTION

PATENT NO. : 4,337,451

DATED : June 29, 1982

INVENTOR(S) : Raymond J. Fox

It is certified that error appears in the above—identified patent and that said Letters Patent is hereby corrected as shown below:

Column 8, line 52, after "means" insert --having opposed ends, one of said opposed ends of said switch blade and said ambient bimetal lever means --

Signed and Sealed this

*Twelfth* Day of *October 1982*

[SEAL]

*Attest:*

GERALD J. MOSSINGHOFF

*Attesting Officer*

*Commissioner of Patents and Trademarks*